US005186454A

United States Patent [19]

Kitahara

[11] Patent Number: 5,186,454

[45] Date of Patent: Feb. 16, 1993

[54] APPARATUS FOR DISTRIBUTING SHEET MEMBERS

[75] Inventor: Makoto Kitahara, Tokyo, Japan

[73] Assignee: Canon Kabushiki Kaisha, Tokyo, Japan

[21] Appl. No.: 704,601

[22] Filed: May 23, 1991

[30] Foreign Application Priority Data

May 28, 1990 [JP] Japan ..... 2-139031

[51] Int. Cl.[5] ..... B65H 39/10

[52] U.S. Cl. ..... 271/288; 271/292; 271/294; 271/176

[58] Field of Search ..... 271/294, 292, 176, 288, 271/295, 287

[56] References Cited

U.S. PATENT DOCUMENTS 4,449,812 5/1984 Furuichi et al. ..... 271/294 X
4,974,828 12/1990 Matsuo et al. ..... 271/294 X
5,042,793 8/1991 Miyake ..... 271/294 X

*Primary Examiner*—David H. Bollinger

[57] ABSTRACT

An apparatus for sorting sheet members, having a plurality of bin trays for accommodating sheet members, sheet member discharge rollers for discharging sheet members into the bin trays, a bin tray lift for moving the bin trays upward or downward at the time of discharge of each sheet member, and a controller for changing the process of discharging the sheet members in accordance with upward and downward movements of the bin trays so that the sheet members are landed on the bin trays by generally the same timing after discharge.

8 Claims, 7 Drawing Sheets

APPARATUS FOR DISTRIBUTING SHEET MEMBERS

BACKGROUND OF THE INVENTION

1. Field of the Invention

This invention relates to an apparatus for distributing sheet members and, more particularly, to a sheet distributor of the bin moving type, which distributes sheets by moving a group of bin trays relative to a sheet discharging means.

2. Description of the Prior Art

Conventional sheet distributors of this kind have a construction such as that shown in FIG. 1.

A sheet sorting unit 32 is connected to an image forming apparatus 31 which has a pair of transport rollers 36 for transporting a sheet member 5 on which an image has been formed and a pair of discharge rollers 6 for discharging the sheet member 5 out of the image forming apparatus.

The sheet sorting unit 32 has a pair of transport rollers 40 for transporting the sheet member 5 discharged from the image forming apparatus 31, discharge rollers 41, a guide plate 42 disposed between the transport rollers 40 and discharge rollers 41 to form a guide path 12, a bin unit 46 having a plurality of bin trays 45 (45*a* to 45*j*), and other components known to those skilled in the art. The bin unit 46 is moved in the direction of arrow 47 or 49 relative to the pair of discharge rollers 41 by an unillustrated lift mechanism so that a selected one of the group of bin trays 45 faces the pair of transport rollers 41. A sheet sensor 50 for detecting the sheet member in the guide path 12 is provided at a suitable position on the guide plate 42.

The operation of this sheet sorting unit will be described below with reference to corresponding step numbers of the timing chart of FIG. 3 of the accompanying drawings.

(1): When image formation in image forming apparatus 31 is started, a start signal is sent from image forming apparatus 31 to sheet sorting unit 32.

(2): In response to the start signal from image forming apparatus 31, transport rollers 40 and discharge rollers 41 rotate in the direction for transporting and discharging sheet member 5, and bin unit 46 is moved downward in the direction of arrow 49 to be set in a home position H.P such that the uppermost bin tray 45*a* faces the pair of discharge rollers 41 and bin unit 46 is ready for sheet discharge.

(3): Sheet member 5 is discharged from the image forming apparatus 31, is fed into guide path 12 by transport rollers 40 and is detected in guide path 12 by sheet sensor 50.

(4): Sheet member 5 is discharged into bin tray 45*a* by the pair of discharge rollers 41.

(5): The trailing end of sheet member 5 passes the sensing position of sheet sensor 50.

(6): When a predetermined length of time after the time point (5) has passed, the trailing end of sheet member 5 passes through the nip between the pair of discharge rollers 41, the bin unit lift mechanism (not shown) is driven.

(7): By the operation of the bin unit lift mechanism, bin unit 46 is shifted upward in the direction of arrow 47, a distance corresponding to one bin tray, so that bin tray 45*b* faces the pair of discharge rollers 41.

(8): The sorting unit is maintained in a waiting state to prepare for discharge of second sheet 5.

(9): Thereafter, second sheet 5 is discharged from image forming apparatus 31, and the same operation as the step (3) is started.

Subsequently, the same operations as steps (4) to (9) are repeated, thus performing sorting and transportation of sheet members 5.

After a predetermined number of sheets have been distributed by moving the group of bin trays upward, other sheet members are distributed in the same manner while moving the group of bin trays downward.

The condition of sheet members distributed by moving the group of bin trays upward and the condition of sheet members distributed by moving the group of bin trays downward are as described below.

FIG. 2(*a*) is a diagram of a case of discharging the sheet member into one of the group of bin trays while moving the group of bin trays downward. A predetermined time after passage of the trailing end of the sheet member through the position of the sensor 50, downward movement of the group of bin trays is started. In this case, if, for example, bin tray 45*b* starts moving downward before the sheet member lands on the bin tray 45*b*, the locus of the trailing end of the sheet member to be landed on the bin tray 45*b* is formed as indicated by arrow A so that the sheet member glides through a long distance, as the bin tray 45*b* is shifted from the position indicated by the dot-dash line to the position indicated by the solid line. That is, the bin tray moves in the same direction as the glide-falling of the sheet member. This phenomenon is particularly noticeable when the sheet sorter is used in combination with a high-speed printer in such a manner that the sheet discharge interval is short. It is considered that in this discharge condition the gliding terminates when the trailing end of the sheet member going backward is brought into contact with a bent end portion $45_1$ formed as an end guide of the bin tray.

FIG. 2(*b*) is a diagram of a case of discharging the sheet member into one of the bin trays while moving the group of bin trays upward. In this case, if the upward movement of the group of bin trays is started before the sheet member lands on the bin tray, the locus of the trailing end of the sheet member to be landed on the bin tray 45*b* is formed as indicated by arrow B so that the gliding distance is shorter, as the bin tray is shifted from the position indicated by the dot-dash line to the position indicated by the solid line. This is because the bin tray is moved toward the sheet member. This phenomenon is also particularly noticeable when the sheet sorter is used in combination with a high-speed printer in such a manner that the sheet discharge interval is short.

As shown in FIGS. 2(*a*) and 2(*b*), the distance through which the sheet member glides (stays in the air) varies with respect to the upward and downward movements of the bin tray, so that sheet members discharged into the bin tray will not normally be uniformly placed and laid on each other, resulting in a sheet return failure or disorder of sheets.

SUMMARY OF THE INVENTION

It is an object of the present invention is to provide a sheet distributor that overcomes the above-described problems of the prior art and is capable of suitably stacking sheet members.

It is another object of the invention to provide a sheet distributor capable of suitably stacking and accommodating sheet members in each bin tray irrespective of the direction of movement of the group of bin trays.

To achieve these objects, according to the present invention, there is provided a sheet distributor characterized by controlling factors of the sheet discharge process (including the discharge speed, the speed at which the group of bin trays are moved, and the timing of moving the group of bin trays) according to the direction of movement of the group of bin trays.

In one aspect of the invention, there is provided an apparatus for sorting sheet members having a plurality of bin trays for accommodating the sheet members, a sheet member discharge means for discharging sheet members into the bin trays, a bin tray moving means for moving the bin trays upward and downward at the time of discharge of each sheet member and a control means for controlling the apparatus in accordance with upward and downward movements of the plurality of bin trays so that each of the sheet members lands on the bin tray in generally the same length of time after it is discharged by the sheet member discharging means.

In another aspect of the invention, there is provided an image forming apparatus having a sheet distributor and including an image forming means, a plurality of bin trays for accommodating sheet members on which images have been formed by the image forming means, a sheet member discharge means for discharging the sheet members into the bin trays, bin tray moving means for moving the bin trays upward and downward at the time of discharge of each of the sheet members and a control means for controlling the apparatus in accordance with upward and downward movements of the plurality of bin trays so that each of the sheet members lands on the bin trays in generally the same length of time after it is discharged by the sheet member discharge means.

The sheet distributor provided can neatly stack and accommodate sheet members in each bin tray irrespective of the direction of movement of the group of bin trays by controlling the sheet discharge process according to the direction of movement of the group of bin trays.

DESCRIPTION OF THE PREFERRED EMBODIMENTS

Figure 1:
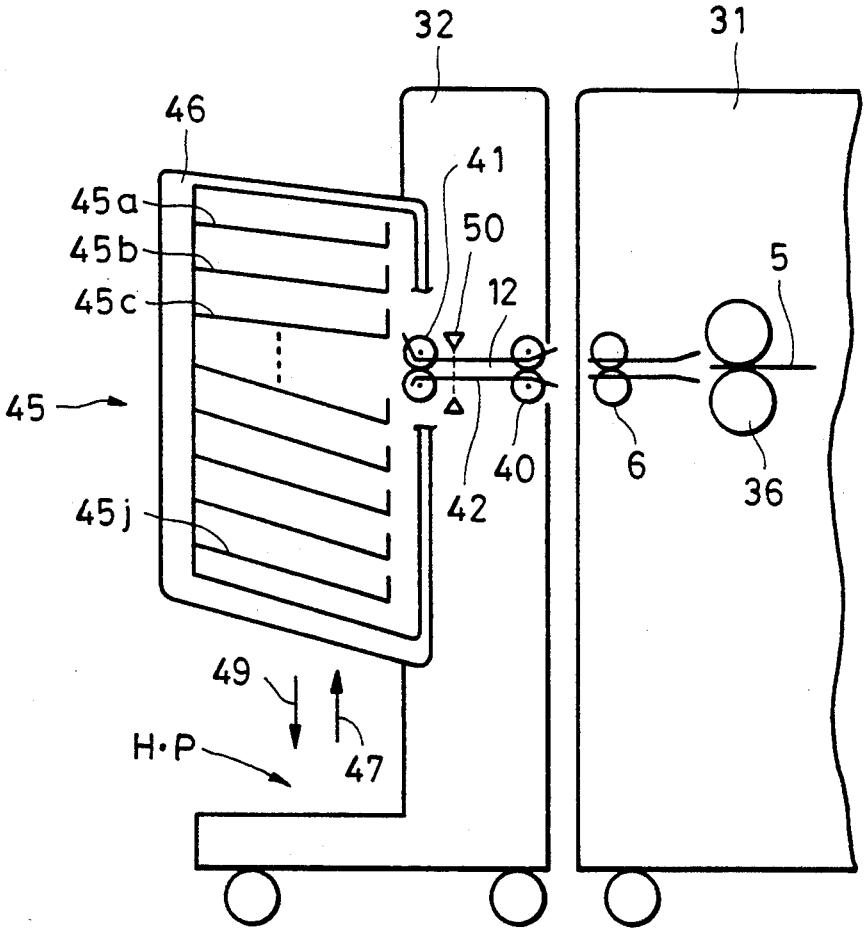
FIG. 1 PRIOR ART
FIG. 1 is a cross-sectional view of a conventional sheet storing unit.
Figure 2A:
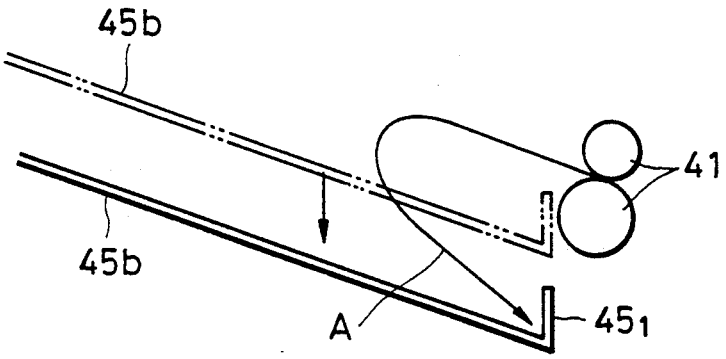
FIG. 2(a) PRIOR ART
FIG. 2(*a*) and 2(*b*) are diagrams of the sheet discharge process into a single bin of the sheet sorter shown in FIG.
Figure 2B:
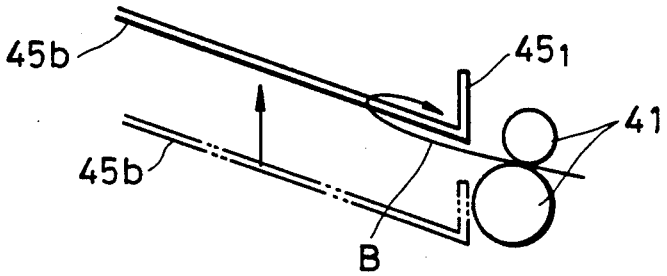
FIG. 2(b) PRIOR ART
Figure 3:
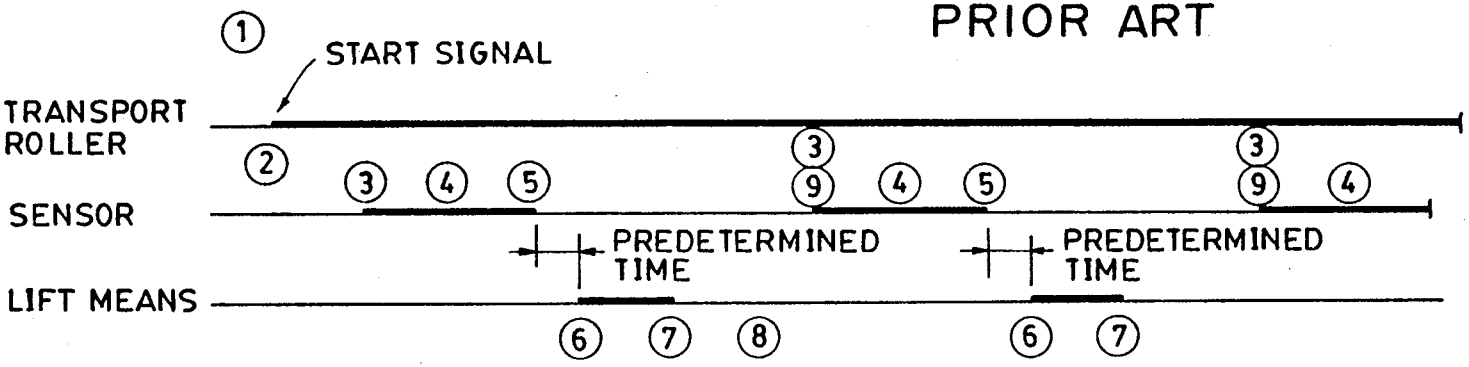
FIG. 3 PRIOR ART
FIG. 3 is a timing chart of the operation of the sheet sorter shown in FIG. 1.

Embodiments of the present invention will be described below with reference to the accompanying drawings. The same reference numeral in each drawings represents the same element.

Figure 4:
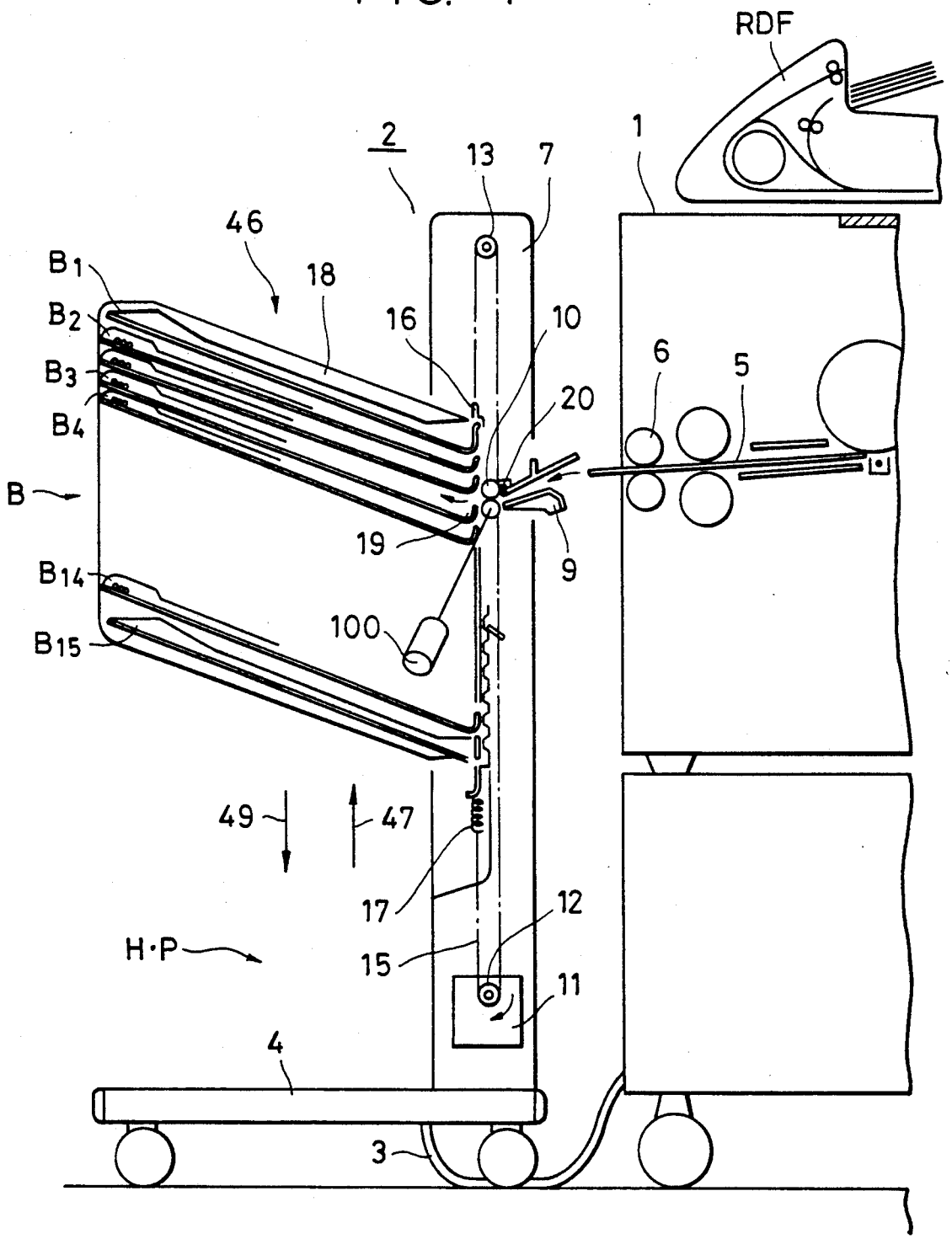
FIG. 4 is a cross-sectional view of a sheet sorter to which an embodiment of the present invention is applied.

FIG. 4 is a longitudinal sectional view of a sheet member sorting apparatus (hereinafter referred to as "sorter") in accordance with an embodiment of the present invention.

An image forming apparatus 1 and a sorter 2 are electrically connected by a cable 3. The sorter 2 has a pair of supports 7 standing upright on a base 4. A carry-in guide 9 and a pair of transport rollers 10 are disposed between the supports 7. The carry-in guide 9 has a sheet inlet facing a pair of discharge rollers 6 of the image forming apparatus 1 and is fixed to the supports 7. The transport rollers 10 are rotatably disposed in positions downstream of the transport guide 9. A chain 15 is wrapped around a sprocket 12 of a motor 11 fixed to a lower portion of each support 7 and sprockets 13 axially supported on upper portions of each support 7. A lift member 16 and a tension spring 17, engaged at its one end with the lift member 16, are disposed at a suitable position on the outside of each chain 15 (on the left side as viewed in FIG. 4) and are connected to the chain 15.

Fore ends of a pair of left and right bin support plates 18 are fixed to the lift members 16. Two side portions of a plurality of bin trays B ($B_1$ to $B_{15}$) are fixed to the bin support plates 18. The bin support plates 18 and the bin trays $B_1$ to $B_{15}$ constitute a bin unit 46. Sheet member 5, discharged from the pair of discharge rollers 6 of the image forming apparatus 1, is inserted into opposing transport guide 9 of the sheet sorter 2 to be led to the transport rollers 10. Each bin tray B has a sheet reception port 19, which can face the nip between the pair of transport rollers 10. The sheet member 5 discharged from the pair of transport rollers 10 is placed and accommodated in the bin tray B facing the the pair of transport rollers 10 (bin tray $B_3$ in the state shown in FIG. 4). A sheet sensor 20 for detecting passage of sheet member 5 is provided at a position along the sheet path on the carry-in guide 9.

The bin support plates 18 are attached to the lift members 16 as described above. As the chains are rotated by the rotation of the motor 11, the lift members 16 and the bin support plates 18 are moved upward in direction 47 or downward in direction 49. The sheet reception ports 19 of the bin trays B1 to B15 can thereby be set successively to positions at which each faces the pair of transport rollers 10. That is, the bin unit 46 can be moved upward or downward through a distance corresponding to the distance between the bin trays B1 and B15.

Figure 5:
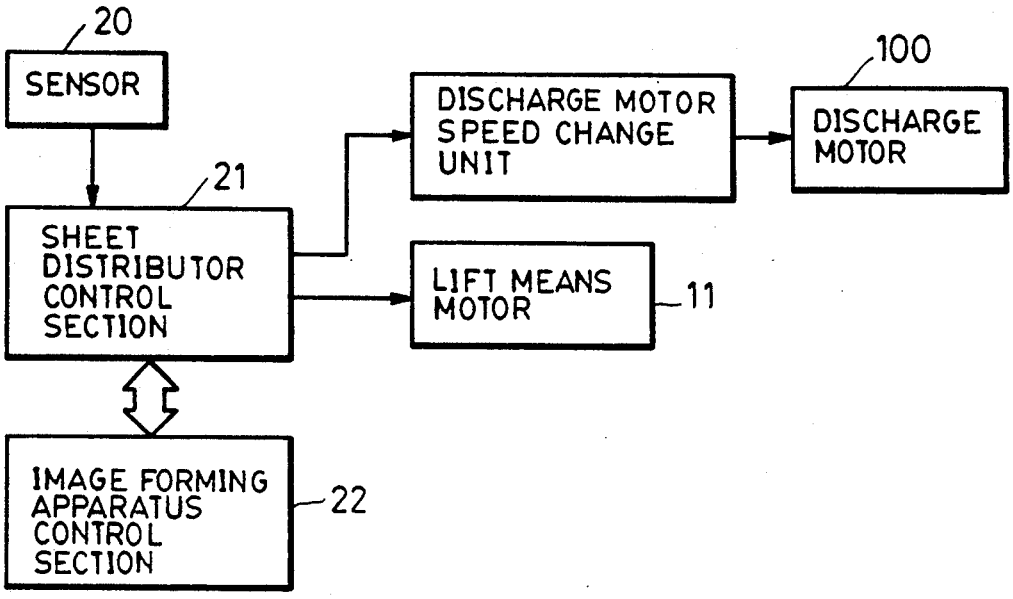
FIG. 5 is a block diagram of the motors and controls of the present invention.

The sorter (sheet member sorting apparatus) 2 has a control section 21 (as shown in FIG. 5) whereby it communicates with a control section 22 of the image forming apparatus 1. The above-described motor 11 is provided as a lift means. A transport motor 100 rotates transport rollers 10. Motor 11 and transport motor 100 are connected to output terminals of the control section 21.

Figure 7:
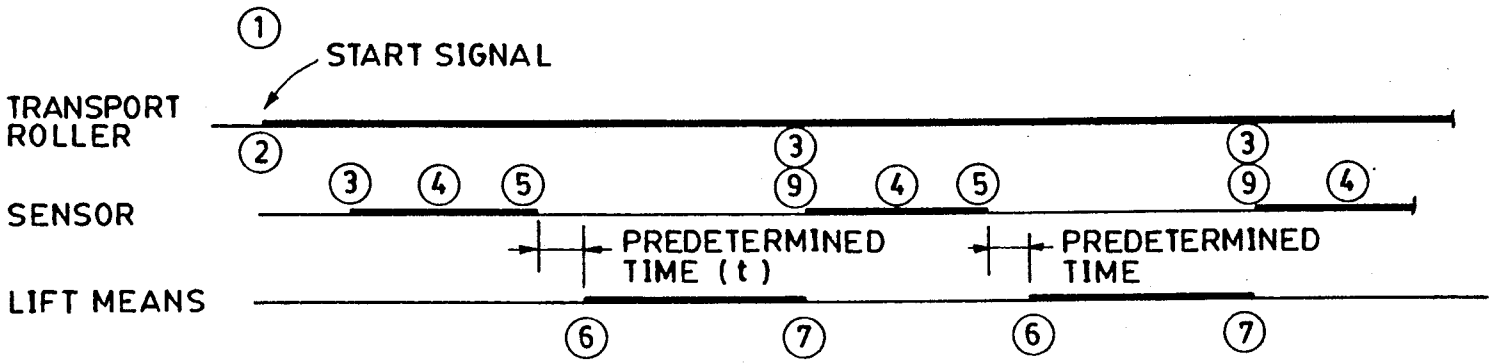
FIG. 7 is a timing chart of the operation of the sheet sorter of one embodiment of the present invention.

The operation of the sorter 2 will now be described below with reference to corresponding step numbers of the timing chart of FIG. 7.

①: When the operation of image forming apparatus 1 is started, a start signal is sent from image forming apparatus 1 to sheet sorter 2.

②: In response to the start signal from image forming apparatus 1, the pair of transport rollers 10 rotate in the sheet discharging direction, and the bin unit is moved downward returning to a home position H.P, i.e., the position at which the uppermost bin tray $B_1$ faces the pair of transport rollers 10, so that the bin unit is ready for discharge of sheet member 5.

(3): Sheet member 5 is discharged from the image forming apparatus 1, and the leading end of sheet member 5 reaches the sheet sensor 20 in the transport guide 9.

(4): Sheet member 5 is discharged into downstream bin tray B1 from the pair of transport rollers 10.

(5): The trailing end of sheet member 5 passes the sensing position of sheet sensor 20.

(6): A predetermined time t after the time point (5), such that the trailing end of sheet member 5 has passed through the nip between the pair of transport rollers 10, the motor 11, which constitutes a bin unit lift means, is driven.

(7): By the rotation of the motor 11, bin unit 46 is shifted upward in the direction of arrow 47 a distance corresponding to one bin tray to a position at which bin tray $B_2$ faces the pair of transport rollers 10. At this position, the upward movement of bin unit 46 is stopped.

(8): Second sheet 5 is discharged from image forming apparatus 1 substantially simultaneously with the stoppage of the upward movement of bin unit 46 in step (7), and the same operation as the step (3) is started.

Subsequently, the same operations as those performed in steps (3) to (4) and (5) are repeated, thereby sorting and transporting sheet members 5.

After a predetermined number of sheets have been distributed by moving the group of bin trays upward, other sheet members are distributed in the same manner while moving the group of bin trays downward (in the direction of arrow 49).

In the operation (4) of the above process, the sheet member 5 is discharged at a speed $V_1$. However, when sheet members are distributed as the group of bin trays are moved downward, each sheet member 5 is discharged into the bin tray at a speed $V_2$. $V_1$ and $V_2$ are selected so that $V_1 > V_2$. Consequently, the distance through which each sheet member glides (corresponding to the time between the moment at which each sheet member is discharged and the moment at which its trailing end contacts the inlet end of the bin tray after gliding backward) is approximated to the gliding distance with respect to the upward movement of the group of bin trays. The stack of sheet members in the bin trays is thereby made generally uniform irrespective of the direction of movement of the group of bin trays.

That is, where each sheet member 5 is discharged at a high speed, it flies out through a large distance and the time taken for the sheet member to return is long. The sheet returning time is further increased when the bin trays are moved downward. To cope with this problem, when the bin trays are moved downward, each sheet member is discharged at a lower speed so that the distance through which it flies is limited, thereby enabling discharged sheet members to immediately fall in a stack on the bin trays.

Figure 6:
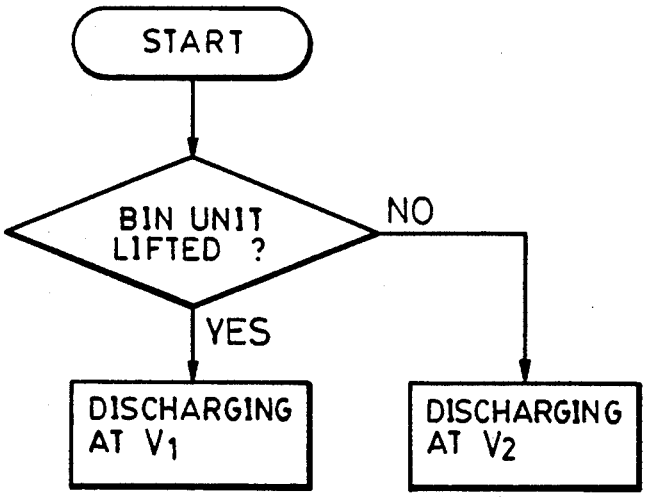
FIG. 6 is a flow chart of a discrimination portion of the control in an embodiment of the present invention.

FIG. 6 is a flow chart of a discrimination routine for the sheet distributor control section. By the operation of this routine, the sheet member 5 is discharged at the speed $V_1$ when the group of bin trays is moved upward and sheet member 5 is discharged at the speed $V_2$ when the group of bin trays is moved downward. To change the discharge speed, the discharge motor speed change unit is controlled by an upward and downward signal to select the speed of rotation of the motor 100.

More specifically, it is assumed here that the time for the returning of each sheet member 5 discharged at the speed $V_1$ when the bin trays are moved upward is two seconds. If the discharge speed during the discharge operation that occurs as the bin trays move downward, that is, wherein each bin tray is moved away from sheet members, is the same as the discharge speed during the discharge operation moving the bin trays upward, the time taken to place each discharged sheet member 5 on the bin tray when the bin tray is moved downward is one second (one half of two seconds) longer than the time taken when the bin tray is moved upward.

In this case, according to the present invention, the speed $V_2$ may be determined so that the time for returning of each sheet member discharged at the speed $V_2$ when the bins are moved downward is one second. Consequently, the time taken to complete stacking of sheet members in the bin trays is substantially constant with respect to upward and downward bin tray movements, thus improving the stacking performance. The improvement thereby achieved is not particularly limited by the selection of the returning or gliding time.

Figure 8:
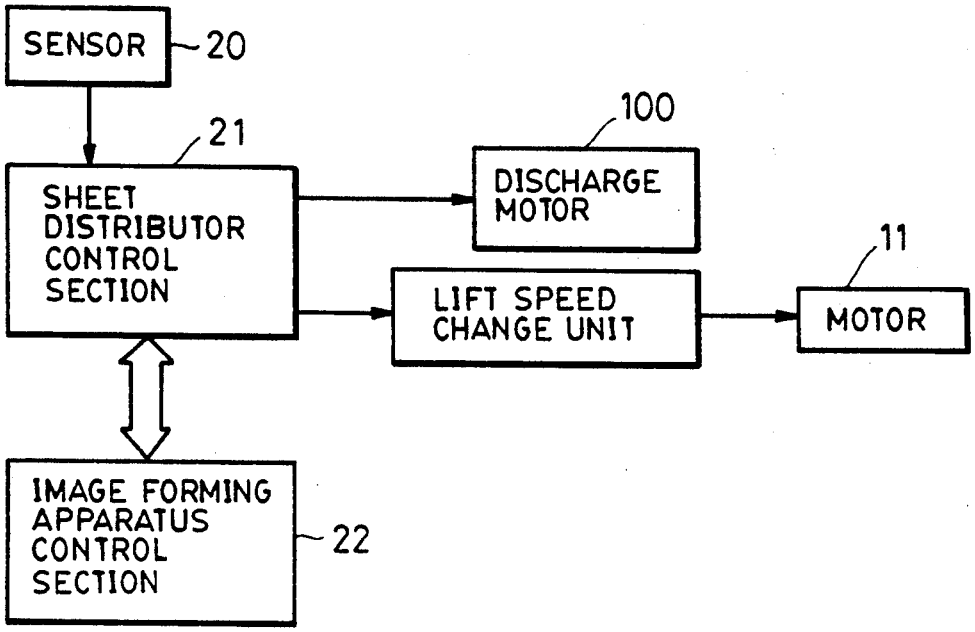
FIGS. 8, 9, and 10 are block diagrams of the motors and controls for other embodiments of the present invention.

In the above-described embodiment, sheet members are distributed by changing the speed at which each sheet member is discharged into the bin tray between $V_1$ and $V_2$ with respect to upward and downward movements of the group of bins. Alternatively, the speed at which the group of bins are moved may be changed (FIG. 8). One of two speeds of motor 11 may be selected to change the bin moving speed.

For example, with respect to the above-described operations (6) and (7), the group of bins are shifted upward at a speed of $V_3$. For sheet distributing operation moving the groups of bins downward, the bin shifting speed is set to $V_4$. The speed can be selected by controlling the rotational speed of the motor 11 The speeds $V_3$ and $V_4$ are determined so that $V_3 > V_4$, thereby enabling sheet members to be stacked uniformly irrespective of the direction of movement of the groups of bins.

Figure 9:
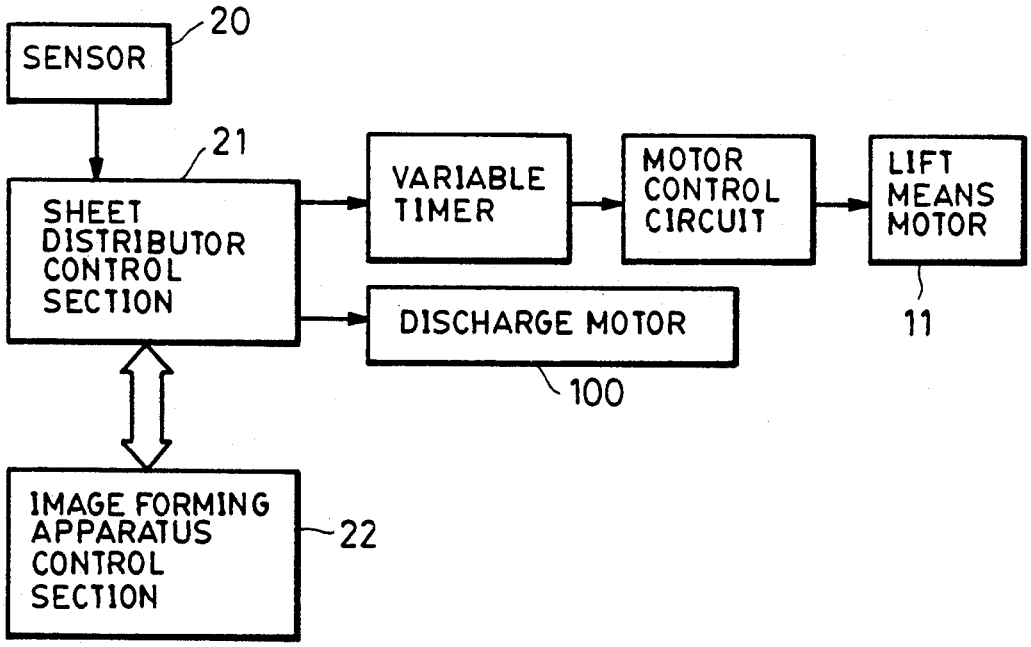

Further, the time t between the moment at which each sheet member passes the sensing position of the sensor 20 and the moment at which the movement of the groups of bins is started may be changed (FIG. 9). With respect to the above-described operations (5) and (6), the upward movement of the group of bins is started $t_1$ time after the moment at which the sheet member passes the sensing position. When sheet members are distributed while the group of bins are moved downward, the movement of the group of bins is started after a corresponding time $t_2$. The times $t_1$ and $t_2$ are selected so that $t_1 < t_2$. It is thereby possible to stack sheet members uniformly irrespective of the direction of movement of the groups of bins.

Figure 10:
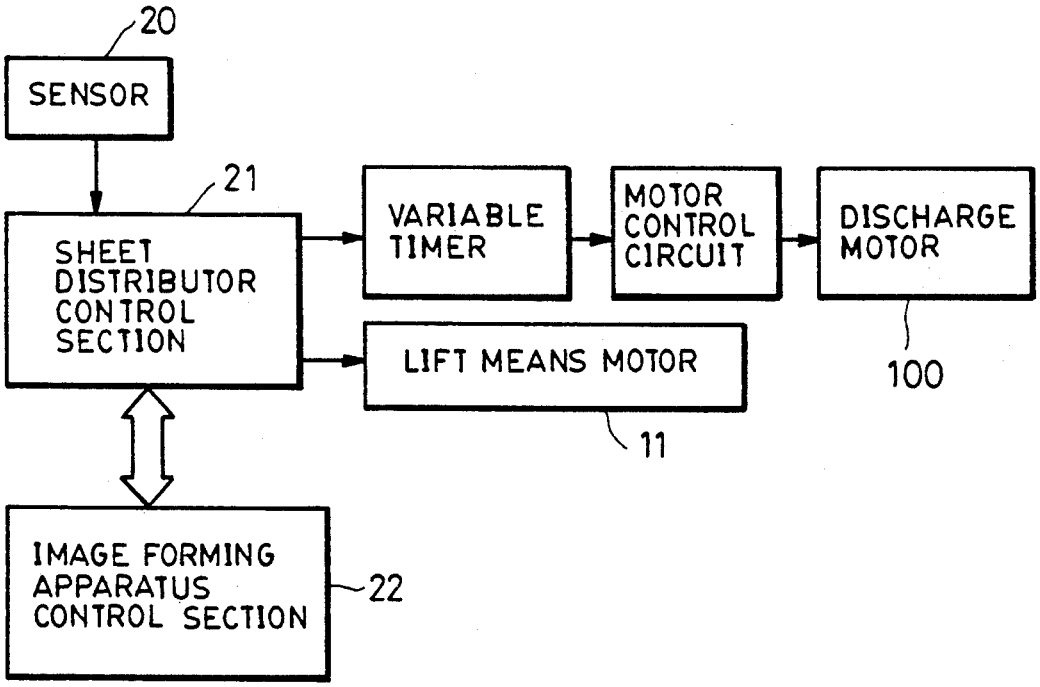

Similarly, the control section for controlling the motor 100 may be provided with a variable timer to change the time (discharge timing) after the moment at which the sheet member is detected with the sensor 20 (FIG. 10). The discharge time is delayed when the bin trays are moved upward or is advanced (or returned to the normal time) when the bin trays are moved downward.

While the present invention has been described with respect to what is presently considered to be the preferred embodiments, it is to be understood that the invention is not limited to the disclosed embodiments. The present invention is intended to cover various modifications and equivalent arrangements included within the spirit and scope of the appended claims.

What is claimed is:

1. An apparatus for sorting sheet members comprising:

a plurality of bin trays for accommodating sheet members;

sheet member discharge means for discharging sheet members into said bin trays;

bin tray moving means for moving said bin trays upward and downward at the time of discharge of each sheet member; and control means for changing a controlling factor for discharging said sheet members in accordance with upward and downward movements of said plurality of bin trays so that each of the sheet members lands on said bin trays in generally the same length of time after it is discharged by said sheet member discharge means.

2. An apparatus for sorting sheet members according to claim 1, further comprising means for changing a discharge speed of said sheet member discharge means, wherein under the control of said control means, the discharge speed is selected as $V_1$ when said bin trays are moved upward and $V_2$ when said bin trays are moved downward, the relationship between the speeds $V_1$ and $V_2$ being $V_1 > V_2$.

3. An apparatus for sorting sheet members according to claim 1 further comprising timing means for controlling the discharge timing of said sheet member discharge means, wherein under the control of said timing means, the time when said discharge means discharges each sheet member is selected as $t_3$ when said bin trays are moved upward and $t_4$ when said bin trays are moved downward, the relationship between $t_3$ and $t_4$ being $t_3 > t_4$.

4. An image forming apparatus having a sheet distributor, comprising:

image forming means;

a plurality of bin trays for accommodating sheet members on which images have been formed by said image forming means;

sheet member discharge means for discharging said sheet members into said bin trays;

bin tray moving means for moving said bin trays upward and downward at the time of discharge of each of said sheet members; and control means for changing a controlling factor for discharging said sheet members in accordance with upward and downward movements of said plurality of bin trays so that each of the sheet members lands on said bin trays in generally the same length of time after its discharge by said sheet member discharge means.

5. An apparatus for sorting sheet members comprising:

a plurality of bin trays for accommodating sheet members;

sheet member discharge means for discharging sheet members into said bin trays;

bin tray moving means for moving said bin trays upward and downward at the time of discharge of each sheet member; and control means for changing a controlling factor for moving said bin trays in accordance with upward and downward movements of said plurality of bin trays so that each of the sheet members lands on said bin trays in generally the same length of time after it discharged by said sheet member discharge means.

6. An apparatus for sorting sheet members according to claim 5, further comprising means for changing the bin tray moving speed of said bin tray moving means, wherein under the control of said control means, the bin tray moving speed is selected as $V_3$ when said bin trays are moved upward and $V_4$ when said bin trays are moved downward, the relationship between the speeds $V_3$ and $V_4$ being $V_3 > V_4$.

7. An apparatus for sorting sheet members according to claim 1, further comprising start means for signalling a start of an operation of said bin tray moving means, wherein under the control of said start means, the time period following sheet discharge when the operation of bin tray moving means is started is selected as $t_1$ when said bin trays are moved upward, or $t_2$ when said bin trays are moved downward, the relationship between $t_1$ and $t_2$ being $t_1 < t_2$.

8. An image forming apparatus having a sheet distributor, comprising:

image forming means;

a plurality of bin trays for accommodating sheet members on which images have been formed by said image forming means;

sheet member discharge means for discharging said sheet members into said bin trays;

bin tray moving means for moving said bin trays upward and downward a the time of discharge of each of said sheet members; and control means for changing a controlling factor for moving said bin trays in accordance with upward and downward movements of said plurality of bin trays so that each of the sheet members lands on said bin trays in generally the same length of time after its discharge by said sheet member discharge means.

* * * * *

UNITED STATES PATENT AND TRADEMARK OFFICE

CERTIFICATE OF CORRECTION

PATENT NO. 5,186,454

DATED February 16, 1993

INVENTOR(S) Makoto KITAHARA

It is certified that error appears in the above-indentified patent and that said Letters Patent is hereby corrected as shown below:

On the title page,

[56] REFERENCES CITED

Insert: --Attorney, Agent, or Firm--Fitzpatrick, Cella, Harper & Scinto--.

Column 4

Line 2, "ings" should read --ing--.

Line 35, "the the" should read --the--.

Column 5

Line 9, "tray B1" should read --tray $B_1$--.

Line 28, "4 and 6" should read --7 and 9--.

Column 6

Line 36, "motor 11" should read --motor 11.--.

Column 8

Line 28, change "claim 1," to --claim 5,--.

Line 45, "a" should read --at--.

Signed and Sealed this

Eighth Day of February, 1994

Bruce Lehman

*Attest:*

BRUCE LEHMAN

*Attesting Officer*

*Commissioner of Patents and Trademarks*